US007049909B2

(12) United States Patent
Denis et al.

(10) Patent No.: US 7,049,909 B2
(45) Date of Patent: May 23, 2006

(54) CERAMIC MICROWAVE WINDOW HAVING A PRESTRESSED RING SURROUNDING THE WINDOW

(75) Inventors: Philippe Denis, Choisy le Roi (FR); Edmond Boghossian, Clamart (FR)

(73) Assignee: Thales Electron Devices S.A., Velizy (FR)

( * ) Notice: Subject to any disclaimer, the term of this patent is extended or adjusted under 35 U.S.C. 154(b) by 28 days.

(21) Appl. No.: 10/470,001

(22) PCT Filed: Feb. 22, 2002

(86) PCT No.: PCT/FR02/00666

§ 371 (c)(1),
(2), (4) Date: Dec. 9, 2003

(87) PCT Pub. No.: WO02/069434

PCT Pub. Date: Sep. 6, 2002

(65) Prior Publication Data

US 2004/0080387 A1 Apr. 29, 2004

(30) Foreign Application Priority Data

Feb. 23, 2001 (FR) ..... 01 02512

(51) Int. Cl.
*H01P 1/08* (2006.01)

(52) U.S. Cl. ..... 333/252

(58) Field of Classification Search ..... 333/252
See application file for complete search history.

(56) References Cited

U.S. PATENT DOCUMENTS

| | | | | |
|---|---|---|---|---|
| 3,156,881 A | | 11/1964 | Bobdley | 333/252 |
| 3,436,694 A | * | 4/1969 | Walker | 333/252 |
| 3,936,779 A | | 2/1976 | Achter et al. | 333/252 |
| 4,684,908 A | * | 8/1987 | Kuntzmann et al. | 333/252 |

OTHER PUBLICATIONS

Patent Abstract of Japan vol. 1995, No. 08, Sep. 29, 1995 & JP 07 131201 A, May 19, 1995.
Patent Abstract of Japan, vol. 1997, No. 06, Jun. 30, 1997 & JP 09/036602 A, Feb. 7, 1997.

* cited by examiner

*Primary Examiner*—Benny Lee
(74) *Attorney, Agent, or Firm*—Lowe Hauptman & Berner, LLP

(57) ABSTRACT

The invention relates to microwave windows used for providing a vacuum seal and transmitting the electromagnetic energy output by a high-power microwave tube. The window comprises a dielectric disk and a prestressing ring, placed around the periphery of the disk, exerts, when at rest, a radial compressive stress all around the disk. In practice, the disk is brazed to the inside of a metal skirt, and the prestressing ring is an annular portion of a holder used for rigidly fastening the microwave window to an output of the microwave tube. The annular portion has an increased thickness and bears locally on the skirt around the disk. The disk may be made of alumina, the metal skirt made of copper, and the holder made of stainless steel. The resistance of the window to thermal stresses is considerably improved thereby.

16 Claims, 1 Drawing Sheet

CERAMIC MICROWAVE WINDOW HAVING A PRESTRESSED RING SURROUNDING THE WINDOW

FIELD OF THE INVENTION

The invention relates to microwave vacuum windows used in principle at the outlet of a power electron tube for transmitting microwave electromagnetic energy between the inside of the tube (under a high vacuum) and the outside (for example at atmospheric pressure).

BACKGROUND OF THE INVENTION

The tube may especially be an amplifier, such as a TWT (travelling wave tube) or a klystron, for example. It may also be an oscillator (magnetron, etc.). Typically, it is desired to send the energy amplified inside the tube to a waveguide containing air. The microwave window allows the electromagnetic energy to pass freely to the waveguide, at least within a given frequency band, while still sealing against the vacuum inside the tube.

Conventionally, a window comprises a flat disk of insulating dielectric through which the electromagnetic energy passes. This disk is usually made of alumina or another ceramic having not only very good dielectric properties but also a high thermal conductivity and good resistance to high temperatures and to large temperature gradients. This is because, for high-power tubes operating with high electric fields, passage of the energy induces losses in the dielectric, hence substantial heating. The tubes in question here may provide power levels of several tens of kilowatts. Typically, the dielectric disk may have dimensions of some ten centimeters in diameter and a thickness of 1 mm to several millimeters.

To achieve a seal, the dielectric disk is brazed all around its periphery to the inner surface of a cylindrical skirt made of metal (generally copper) that surrounds it.

In a previous embodiment, shown in FIG. 1, the cylindrical skirt 10 is itself surrounded by a holder 20, for example made of stainless steel, serving as a support for fastening the dielectric disk 30 and its skirt 10 between the power tube and a waveguide. The dielectric disk 30 is brazed inside the skirt. The holder 20 may be used both as a heat sink and as a transition between the tube and the waveguide. It has an inner part 22 constituting the start of the waveguide, with a peripheral flange 24 used for fastening the waveguide to the holder 20. The upper part 26 of the holder 20 is cylindrical and surrounds the cylindrical skirt 10. This upper part is intended to be welded or brazed around an output port of the power tube (not shown). The bottom and the top of the skirt are brazed to the inside of the holder 20.

The brazed joints between the dielectric disk and the skirt and the brazed joints between the skirt and the holder contribute to maintaining a vacuum seal.

The thermal stresses in operation may be very high due to the high power dissipation occurring in the dielectric disk. The power dissipation is generally a maximum along the center axis and lower around the edges away from the center axis. The thermal conduction properties of the ceramic (especially alumina) allow the heat to be removed radially towards the edges; the copper skirt and the stainless steel holder serve as a heat sink. Despite this radial removal of the heat, the thermal stresses are very high because of the temperature difference between various regions of the ceramic. They are accentuated by the fact that the distribution of the power dissipation in the window is not necessarily completely radial. The stresses may generate cracks in the ceramic, or in the copper, or in the various brazed joints that provide a vacuum seal. The defects that may result from these thermal stresses are totally unacceptable with regard to the tube, once these defects result in a loss of vacuum sealing. This is why the level of power that can pass through the window during use of the tube has to be limited.

It is an object of the invention to produce a microwave window having higher power capabilities than in the prior art, while maintaining the advantages of the existing windows.

SUMMARY OF THE INVENTION

This is achieved by providing a microwave window comprising a dielectric disk, characterized in that the window includes a prestressing ring that surrounds the periphery of the disk and exerts, when at rest, over the entire periphery of the disk, a radial compressive stress directed toward the center of the disk. In practice, it will be preferable to provide a metal skirt brazed around the disk (as in the prior art), the prestressing ring surrounding the metal skirt around the periphery, of the dielectric disk.

Preferably, the prestressing ring is formed by an annular portion of a holder serving to fasten the window to the outlet of a microwave tube, this annular portion bearing locally on an outer surface of the skirt all around the periphery of the dielectric disk. The holder is made of a material much more rigid than the metal skirt.

The holder may be made of stainless steel, the skirt being made of copper and the disk made of alumina. The thickness of the compressive prestressing ring may be about 2 to 3 mm. For example, if the holder is made of a metal about 1 mm in thickness, the prestressing ring may be formed by an overthickness (in total around 3 mm) of metal.

The temperature rise of the dielectric disk does not change from that of the prior art, but the tensile strength is considerably improved.

The prestress is preferably of the order of several tens of bar, or more. It is exerted when at rest, i.e. when the tube is cold; in operation, the more the window heats up the higher the power transmitted through the window. The prestressing ring expands and relieves the internal thermal stresses that are induced in the window because of the large temperature gradients in the window; however, because the ring when cold exerts a radial compressive stress, its expansion when hot does not exert an unacceptably high stress on the brazed joint between the ring and the window.

The invention also relates to a method of producing a microwave window. The method consists in placing a dielectric disk inside a metal skirt, with a braze, and with a small gap between the periphery of the disk and the skirt, in placing the disk and the skirt assembly inside a holder having a prestressing ring that surrounds the skirt over the entire periphery of the disk, a small gap being left between the ring and the skirt, in placing a brazing hoop around this ring with a small gap between the hoop and the ring, the material of the hoop having a lower expansion coefficient than the ring, in heating the assembly comprising the hoop, the ring, the skirt and the disk to a temperature high enough to braze the disk in the skirt, and in leaving the assembly to cool down, the cooling compressively prestressing, radially, the ring onto the skirt and onto the disk.

The brazing hoop is then removed.

During the actual brazing operation, the top and the bottom of the skirt are preferably brazed to the holder. A bead of braze is therefore placed at the appropriate points before the assembly is placed in the brazing furnace.

Preferably, a lubricating substance, preferably graphite, is interposed between the prestressing ring and the metal skirt, which prevents sintering between the ring and the skirt in the event of a rise in temperature of the ring, for example during oven cycles of the microwave tube with the window. These oven cycles are intended to provide degassing to the various parts of the tube while maintaining a high vacuum inside the tube. Sintering between the ring and the skirt, due to the pressure, the friction and the temperature, would result in the ring/skirt bond stiffening and in subsequent risks of a sealing failure.

DESCRIPTION OF THE DRAWINGS

Other features and advantages of the invention will become apparent on reading the following detailed description given with reference to the appended drawings in which.

DETAIL DESCRIPTION OF THE INVENTION

The invention will now be described with regard to FIG. 2, in an example corresponding to an improvement over the window of FIG. 1, for a case in which a metal skirt is interposed between a holder and the dielectric disk, without this example being limiting. In this case, the holder is made of a stronger metal than the metal skirt, and provides the strength of the window assembly.

Figure 1:
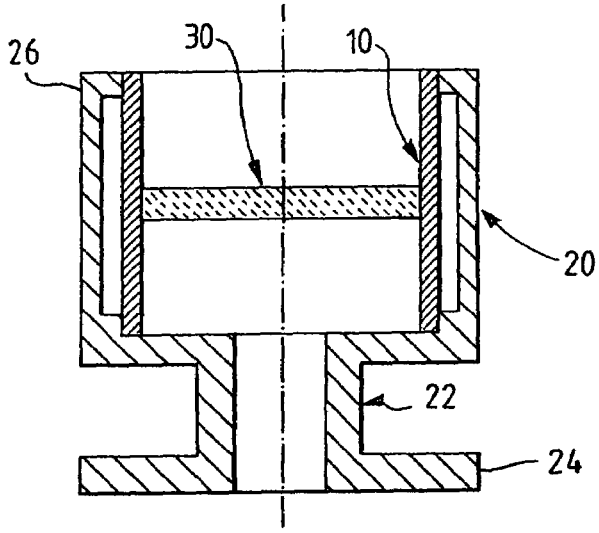
FIG.1 PRIOR ART
FIG. 1, already described, shows a window of the prior art.
Figure 2:
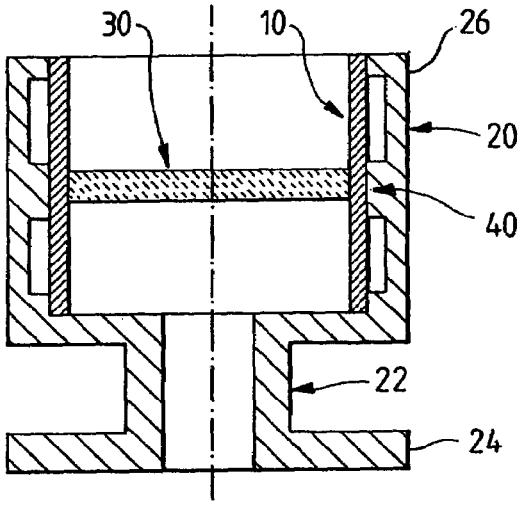
FIG. 2 shows a window according to the invention.
Figure 3:
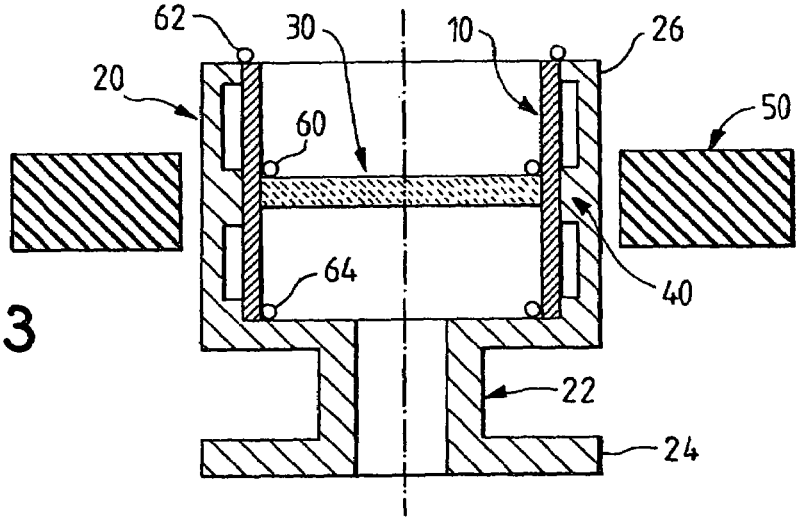
FIG. 3 shows the brazing operation needed to produce the window according to the invention.

In FIGS. 2 and 3, the same elements as in FIG. 1 are labeled by the same reference numbers In FIG. 2, the prestressing ring according to the invention in this case forms an integral part of the holder 20 that surrounds the skirt 10. This ring is denoted by the reference 40. For greater simplicity, it is formed by a local increase in the thickness of the holder. It could also be independent of the holder.

For example, the holder has a cylindrical central part generally surrounding the metal skirt 10, and the ring is formed by a localized region of this cylindrical part, this region having a greater thickness and being located around the periphery of the dielectric disk 30. Typically, for a dielectric disk about 8 to 10 cm in diameter and 1 mm in thickness, the prestressing ring 40 may have a radial thickness of about 3 millimeters over a height of a few millimeters. For example, the holder is made of stainless steel generally about 1 millimeter in thickness around the skirt 10 and locally it has an overthickness (a further 2 millimeters of thickness all around the disk 30).

The inside diameter of the holder, in its cylindrical central part, is greater than the outside diameter of the metal skirt, except at the point where the prestressing ring 40 is; at this point, the inside diameter of the ring is equal to that of the metal skirt, the ring permanently exerting a compressive stress on the skirt 10 and, via the skirt, on the periphery of the dielectric disk 30. In the numerical example indicated above, the inside diameter of the cylindrical central part of the holder 20 is about 1 mm greater than the outside diameter of the skirt 10.

The metal skirt is preferably welded or brazed to the holder, on the one hand via its upper part and on the other hand via its lower part, the dielectric disk being located in a central part of the skirt 10.

The upper part 26 of the holder is shaped so as to be able to be welded in a leaktight manner to the power tube, around an output port for the electromagnetic energy. The tube and its output port are not shown. Likewise, the lower part of the holder 20 is shaped so as to be able to be fastened (but not necessarily in a sealed manner) to an element for using the output power of the tube, for example a waveguide (not shown). A lower fastening flange 24 may be provided for this purpose. The lower part 22 of the holder 20 may be internally machined in order to form a waveguide of dimensions corresponding to the waveguide to which it has to be fastened.

The prestressing ring 40 exerts a high compressive force on the periphery of the skirt and of the dielectric disk and it is preferable to interpose a thin layer of a lubricating substance, preferably a thin layer of graphite, between the ring and the skirt in order to avoid any bonding by sintering in the event of a temperature rise. It will be recalled that sintering is a molecular interpenetration of two materials when the temperature and pressure are high enough. In this case, the presence of quite a high compressive stress (typically 100 bar) means that the risk of sintering during a heat-up is not insignificant. It will also be recalled that heat-up is inevitable, either during manufacture (baking at several hundred degrees of the tube on which the output window is mounted) or during operation at high power.

To produce the window according to the invention, instead of first brazing the dielectric disk in the metal skirt before the skirt is mounted in the holder, the procedure is to mount the disk in the skirt and to mount the skirt in the holder and then to place the assembly, together with a brazing hoop clamped around the holder level with the prestressing ring, in a brazing furnace.

FIG. 3 shows this operation. The brazing hoop is a circular ring 50 whose inside diameter when cold is equal, to within a small difference, to the outside diameter of the holder when cold at the point of the prestressing ring 40. The hoop 50 is made of a rigid material having a lower expansion coefficient than that of the holder (and of the skirt). The dielectric disk also has a lower expansion coefficient than the holder and the skirt.

Typically, the skirt is made of copper, the holder is made of stainless steel and the hoop is made of molybdenum, tungsten or even alumina. The expansion coefficient of molybdenum is about 3 times smaller than that of stainless steel and of copper. The expansion coefficient of alumina is also much smaller than that of the holder (about one third of it).

The dielectric disk is placed in the skirt with a peripheral bead of braze 60. A gap is left between between the disk and the skirt. The molten braze will penetrate, by wetting, the interstice between the disk and the skirt around the periphery of the disk. When cold, the gap is such that thereafter, when hot, during the brazing operation, the gap becomes very small (of the order of 0.1 millimeters), making it possible, however, for the braze material to penetrate the interstice between disk and skirt. The skirt is placed in the holder with, when cold, a small gap between the block and the skirt at the point of the prestressing ring 40. The inside of the ring 40 is precoated with a lubricating substance as mentioned above (in principle, graphite). Beads of braze 62 and 64 are placed at the top and bottom of the skirt 10. The molybdenum hoop 50 is slid, when cold, around the holder containing the metal skirt. The hoop could also be heated before being placed around the cold holder. It is placed level with the prestressing ring 40. The gap between the hoop and the holder is small when introducing (in principle, when cold) the hoop around the holder. This gap becomes zero during the brazing operation.

The assembly is heated to the temperature necessary for the brazing operation. The beads of braze melt. The disk, the skirt, the holder and the hoop expand. However, the hoop 50 expands much less than the holder (and than the skirt). It therefore partly prevents the expansion of the prestressing ring 40. Upon cooling, the prestressing ring 40 contracts, the holder 20 contracts, as does the skirt 10 at the dielectric disk (the stainless steel ring is made of a material much more rigid than the skirt). The skirt 40 exerts compression on the dielectric disk 30, which contracts less. This compression is permanent; it is present at rest, but in operation it is still there. It is radial. It depends on the gaps between the parts, on the materials used, on the diameters of the elements and on the thickness of the prestressing ring. It may be up to 100 bar. It is therefore a high compressive prestress. The hoop 50 is removed after cooling.

When this permanent prestress is present, the overall structure will be much more resistant to cracking when the window is subjected to thermal stresses, either during baking or in operation.

The output port according to the invention may be used in particular as a port for TWTs or for klystrons.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention are broadly disclosed herein. It is therefore intended that the protection granted hereon be limited only by the definition contained in the appended claims and equivalents thereof.

The invention claimed is:

1. A microwave window comprising a dielectric disk, comprising:

a metal skirt brazed around the periphery of the disk and a prestressing ring surrounding the metal skirt around the periphery of the disk and exerting, when at rest, over the entire periphery of the disk, a radial compressive stress directed toward the center of the disk.

2. The microwave window as claimed in claim 1, wherein the prestressing ring is comprised of an annular portion of a holder serving to fasten the window to an outlet of a microwave tube, said annular portion bearing on an outer surface of the metal skirt all around the periphery of the dielectric disk.

3. The microwave window as claimed in claim 2, wherein the holder is comprised of a more rigid metal than the skirt.

4. The microwave window as claimed in claim 3, wherein the skirt is comprised of copper, the holder is comprised of stainless steel and the dielectric disk is comprised of alumina.

5. The microwave window as claimed in claim 4, wherein the compressive prestressing ring has a thickness which is about 3 mm.

6. The microwave window as claimed in claim 4, wherein a graphite lubricating substance, is interposed between the prestressing ring and the metal skirt in order to prevent sintering between the ring and the skirt in the event of a rise in temperature of the ring.

7. The microwave window as claimed in claim 3, the metal skirt is brazed to the holder to the top and at the bottom thereof.

8. The microwave window as claimed in claim 3, wherein the thickness of the compressive prestressing ring is about 3 mm.

9. The microwave window as claimed in claim 3, wherein a lubricating substance, graphite, is interposed between the prestressing ring and the metal skirt in order to prevent sintering between the ring and the skirt in the event of a rise in temperature of the ring.

10. The microwave window as claimed in claim 1, wherein a graphite lubricating substance, is interposed between the prestressing ring and the metal skirt in order to prevent sintering between the ring and the skirt in the event of a rise in temperature of the ring.

11. The microwave window as claimed in claim 10, wherein the compressive stress is several tens of bar or more.

12. The microwave window as claimed in claim 2, wherein a lubricating substance, graphite, is interposed between the prestressing ring and the metal skirt in order to prevent sintering between the ring and the skirt in the event of a rise in temperature of the ring.

13. The microwave window as claimed in claim 2, the metal skirt is brazed to the holder at the top and at the bottom thereof.

14. The microwave window as claimed in claim 1, the metal skirt is brazed to the holder at the top and at the bottom thereof.

15. The microwave window as claimed in claim 2, wherein the compressive prestressing ring has a thickness which is about 3 mm.

16. The microwave window as claimed in claim 1, wherein the compressive prestressing ring has a thickness which is about 3 mm.

* * * * *